US006651366B1

(12) United States Patent
Duncan

(10) Patent No.: US 6,651,366 B1
(45) Date of Patent: Nov. 25, 2003

(54) MODULAR GRAPHIC DISPLAY SYSTEM

(76) Inventor: John Duncan, 53 Comstock, Ivoryton, CT (US) 06442

( * ) Notice: Subject to any disclaimer, the term of this patent is extended or adjusted under 35 U.S.C. 154(b) by 145 days.

(21) Appl. No.: 09/590,737

(22) Filed: Jun. 8, 2000

(51) Int. Cl.[7] ..... G09F 7/00
(52) U.S. Cl. ..... 40/605; 52/586.1
(58) Field of Search ..... 40/605, 610, 729, 40/730; 403/293, 292, 341; 160/135; 52/586.1, 71, 585.1

(56) References Cited

U.S. PATENT DOCUMENTS

| | | | | | |
|---|---|---|---|---|---|
| 304,652 | A | * | 9/1884 | Jory | 40/605 |
| 784,492 | A | * | 5/1905 | Keen | 160/135 |
| 1,506,442 | A | | 8/1924 | O'Hara | |
| 2,526,603 | A | * | 10/1950 | Damroth | 40/605 |
| 2,797,511 | A | | 7/1957 | Zecher | |
| 3,291,319 | A | | 12/1966 | Novales et al. | |
| 3,948,710 | A | * | 4/1976 | Harvey | 156/211 |
| 4,884,352 | A | | 12/1989 | Lipscomb | |
| 5,407,365 | A | | 4/1995 | Lin | |
| 5,421,112 | A | | 6/1995 | Knorr | |
| 5,459,356 | A | | 10/1995 | Schulze et al. | |
| 6,065,258 | A | * | 5/2000 | McClatchy | 42/238.1 |

FOREIGN PATENT DOCUMENTS

| | | |
|---|---|---|
| CH | 252241 | 12/1947 |
| GB | 25878 | 9/1918 |

* cited by examiner

*Primary Examiner*—Cassandra H. Davis
(74) *Attorney, Agent, or Firm*—William A. Simons; William B. Slate; Wiggin & Dana LLP

(57) ABSTRACT

A system and components are provided for assembling at least two boards into a composite. A pair of bridging members may each be secured to an associated board and have a central surface portion spaced apart from the surface of the associated board. An elongate bar is provided having a length, width and thickness effective to permit the bar to be inserted between the central surface portion and board surface of two adjacent bridging members so that the bar tends to hold the two boards in a predetermined alignment.

6 Claims, 14 Drawing Sheets

MODULAR GRAPHIC DISPLAY SYSTEM

BACKGROUND OF THE INVENTION

1. Field of the Invention

This invention relates to printed presentation graphics, and certain media by which these graphics are displayed.

2. Description of the Related Art

When making presentations in corporate meetings, sales meetings, organizational meetings, legal trials, conventions, exhibits, public hearings, classrooms and gatherings of various other audiences, presenters have customarily used visual aids to convey textual and graphic images. Different forms of display boards and paper pads are common examples of such aids. The use of these materials, however, has been constrained by the availability of manageable and convenient sizes of the media on which to display these graphics.

BRIEF SUMMARY OF THE INVENTION

Accordingly, in one aspect the invention is directed to a kit for assembling at least two boards into a composite. The kit includes two bridging members, each having first and second coplanar securing surfaces, and a central surface. The central surface is parallel to, recessed from, and between the securing surfaces. An adhesive on the securing surfaces is provided for securing the bridging member to a back surface of an associated one of the boards so that the central surface is spaced apart from the back surface. The kit includes an elongate bar having a length, a width, and a thickness effective to permit the bar to be inserted between the central surface and the board back surface to engage the bar to the secured bridging member. When the two bridging members are so secured on the two boards and the bar so engaged to both bridging members, the bar tends to hold the two boards in a predetermined alignment.

In various preferred implementations, the kit may comprise exactly two such bars and four such bridging members. The bridging members may preferably each have a plate portion having first and second opposed surfaces and a plate thickness therebetween with an exposed central portion of the second surface defining the bridging member central surface. Each bridging member may preferably include first and second spacer portions, each having first and second opposed surfaces. The first surfaces of the first and second spacer portions may preferably be secured to the plate portion's second surface. The spacer portions may preferably be spaced apart so that the second surfaces of the first and second spacer portions respectively define the first and second securing surfaces. Release material may preferably cover the adhesive on the first and second securing surfaces. The release material may preferably extend beyond an outboard edge of one of the spacer portions by a distance effective to permit gripping by a user's fingers to remove the release material. The distance may preferably be at least 0.1 inch. The spacer portions may preferably each comprise a foam strip with the adhesive on one side and an additional adhesive on the opposite side securing the strip to the plate portion. The plate portion's first surface may preferably bear graphics, optionally including text. The graphics may preferably be on labels applied to the plate portions or may preferably be printed directly on the plate portions. The plate portions may each comprise a layer of polyester film. The first and second securing surfaces may each have a length of 1.0–3.0 inches and a width of 0.5–1.5 inches. A channel bounded by the central surface and inboard sides of the first and second spacer portions may have a width of 0.1–1.0 inch. A thickness between the spacer portions' first and second opposed surfaces may preferably be 0.075–0.15 inch. The elongate bar may comprise coated steel having width and thickness both about ⅛ of an inch.

In another aspect, the invention is directed to a single module for assembling a composite graphic image-bearing assembly. The module includes a graphic display board having front and back surfaces with a board thickness therebetween, first and second parallel perimeter edges with a board width therebetween, and third and fourth parallel perimeter edges with a board height therebetween. A plurality of bridge members are secured to the graphic display board back surface. Each bridge member includes a pair of spacer portions having first surfaces facing and secured to the board back surface and a plate portion bridging the spacer portions and defining a channel between the spacer portions.

In preferred implementations of this module aspect of the invention, the graphic display board may include a foam layer. The thickness may preferably be 3⁄16 of an inch, the width about 20 inches, and the height about 30 inches. There may preferably be exactly four bridging members. Each such bridging member may preferably be centered along an associated one of the board perimeter edges and recessed therefrom by an associated offset. The module may be a first module in combination with a second module wherein the offsets of the first module and second module are effective to permit back-to-back nesting of the modules with their boards aligned with each other but their bridging members aside each other so that the bridging members of each board contact the back of the other board. The offsets further permit edge-to-edge assembly of the modules with a connecting bar extending through a channel of the first module and a channel of the second module. The module combination may preferably include a plurality of additional modules assembled in a rectangular edge-to-edge array. Along adjacent edges of any given two adjacent modules in the array, a connecting bar may preferably span the border between such adjacent modules and extend within the bridging member channel associated with each of the adjacent edges. The board front surfaces of each module may preferably be substantially coplanar and each may preferably bear a graphical image portion, the graphical image portions combined to form a single continuous graphical image over the array.

In another aspect, the invention is directed to a composite board system kit including a carrying case including a carrying handle for gripping by a user and at least one interior compartment containing at least four modules, at least four compatible connecting bars, computer-readable media containing image-tiling software for producing tiled images, and a spray adhesive for securing printouts of the images to the boards of the modules.

In another aspect, the invention is directed to a method for assembling a composite board. A plurality of boards are provided having generally rectangular planar front and back surfaces and having four perimeter edges. An associated graphical image portion is applied to front surface of each board. The boards are assembled edge-to-edge to form an array of the boards, the graphical image portions combining to form a single continuous graphical image over the array.

In various preferred implementations of this process aspect of invention, the step of applying may be preceded by or may include providing a digitally-stored graphical image, causing a computer to divide the digitally-stored graphical image into image subportions, a plurality of such image subportions associated with each such board, causing a printer to print the image portions on printable media, and securing the printed media associated with each board to such board so as to form the associated image portion from the associated image subportions, the image portion being substantially continuous across boundaries between the subportions. The step of assembling may be preceded by or may include providing a plurality of bridging members, securing at least two bridging members to the back surface of each board, providing a plurality of elongate bars, and inserting each bar between a bridge central surface and a board back surface of two adjacent bridging members so as to hold the two adjacent boards in a predetermined alignment.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
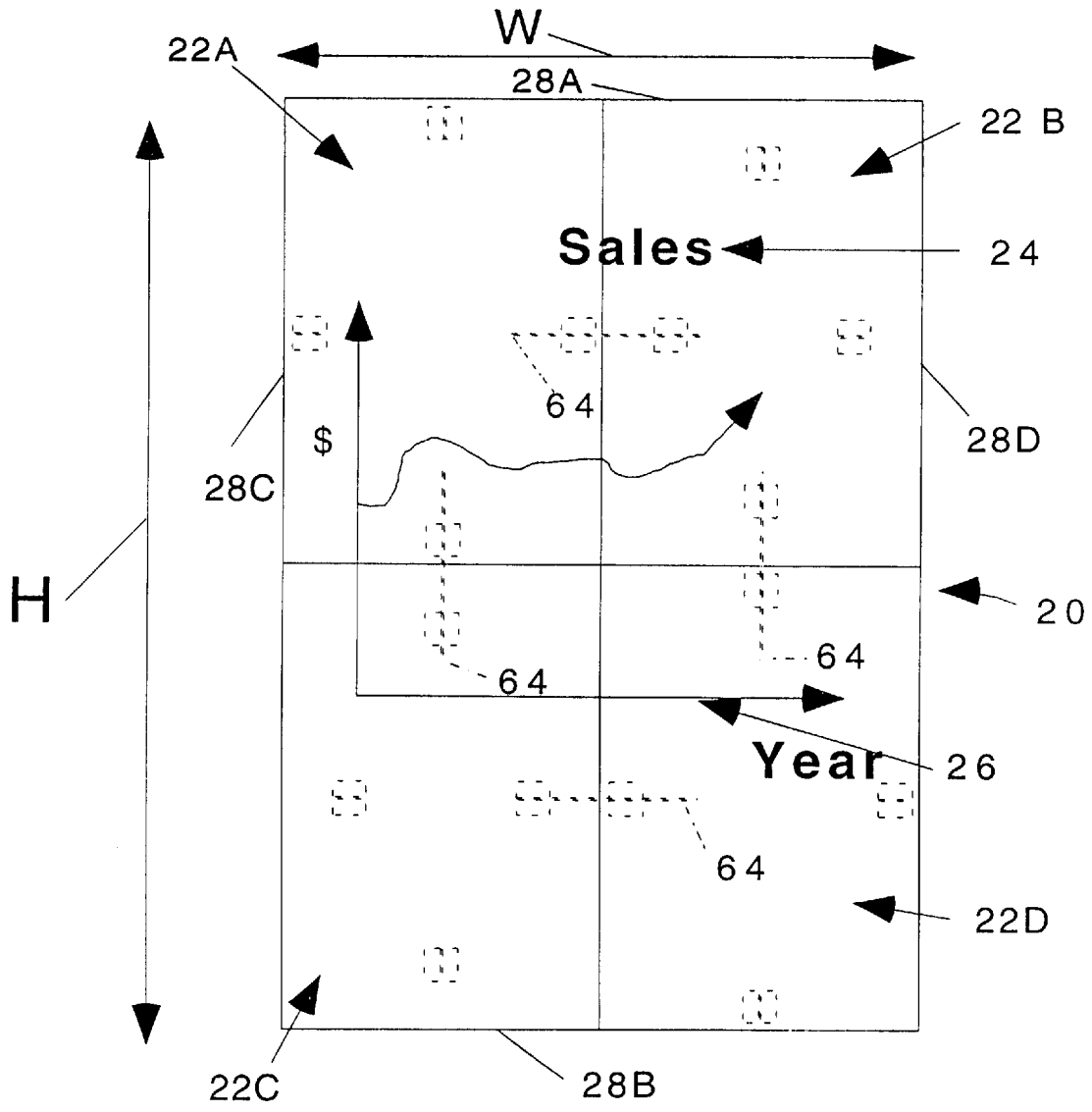
FIG. 1 is a front view of a composite board assembly bearing a graphic image
Figure 2:
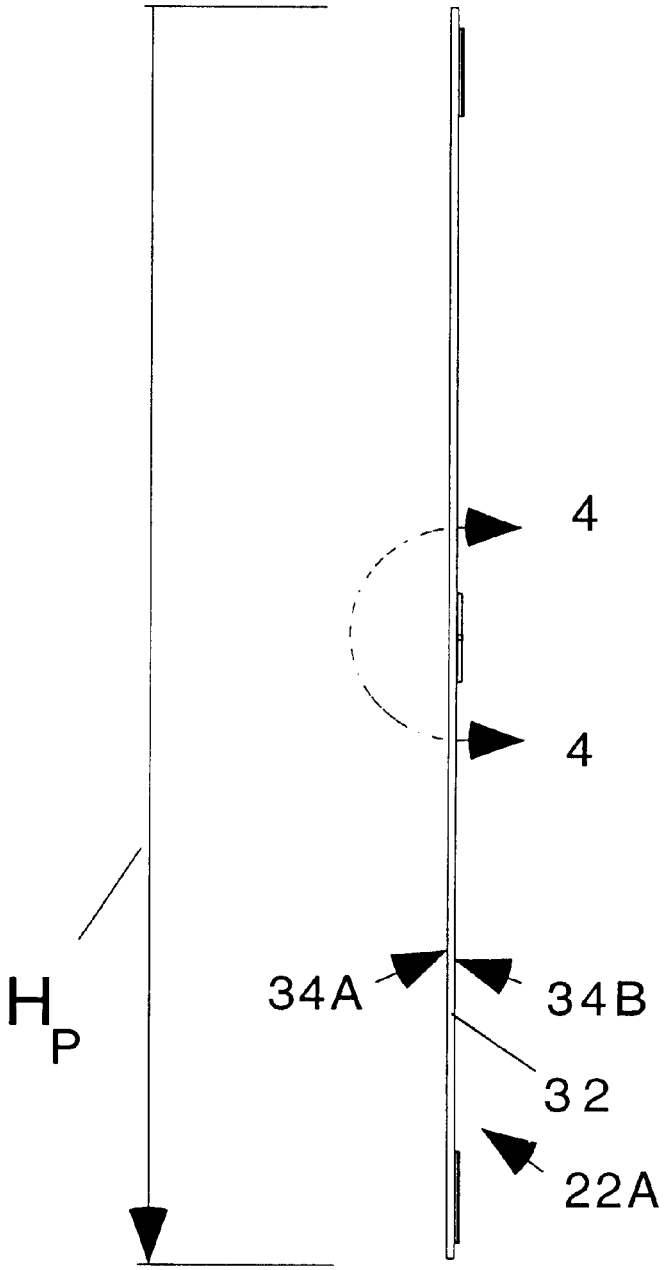
FIG. 2 is an edge-on side view of a single board of the assembly of FIG. 1.
Figure 3:
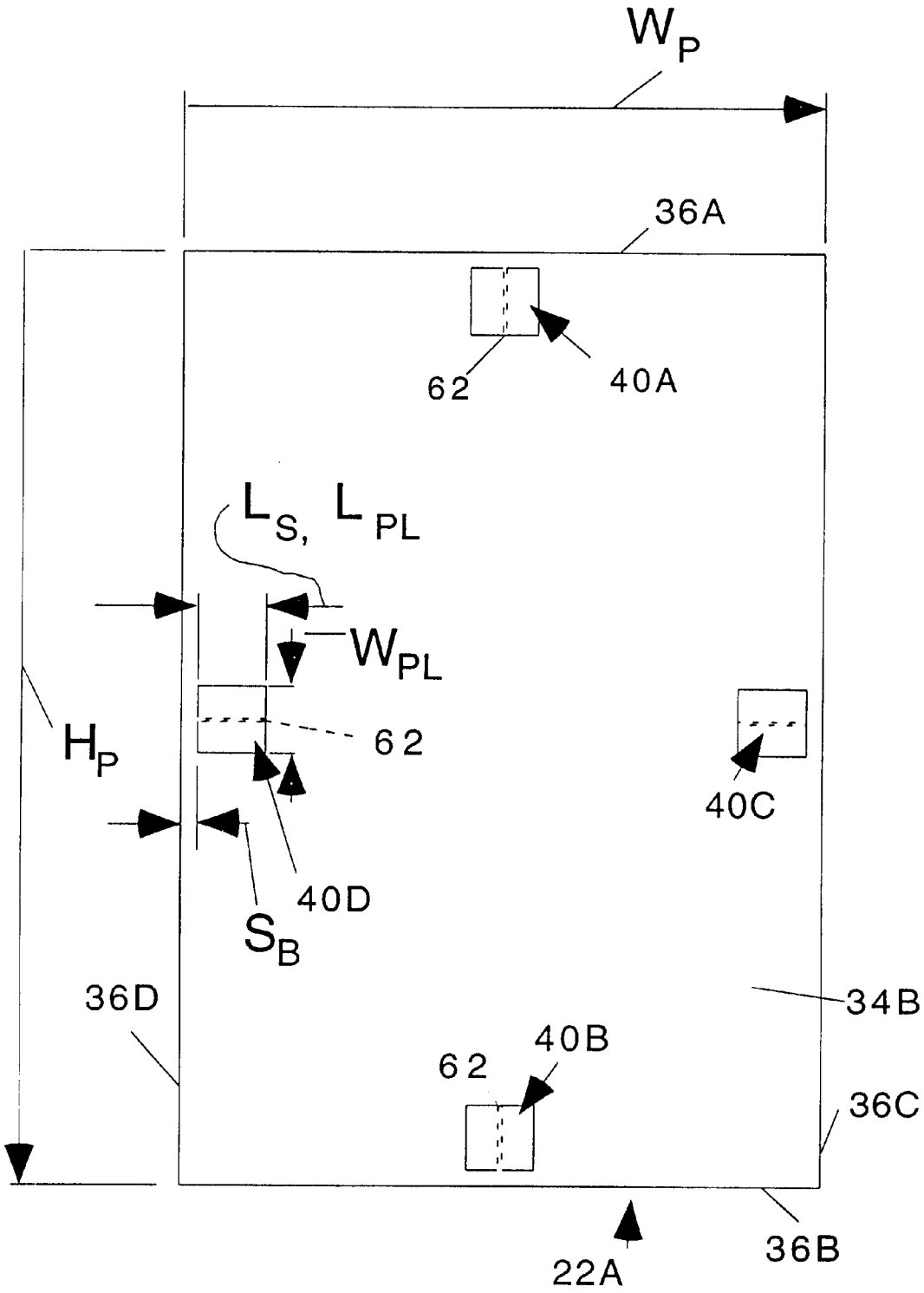
FIG. 3 is a back view of the board of FIG. 2.
Figure 4:
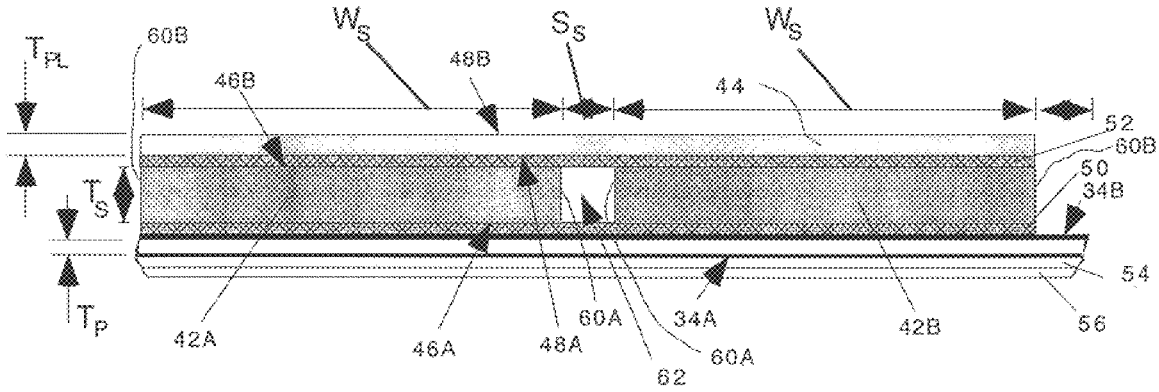
FIG. 4 is an enlarged view of a bridge member portion of the board of FIG. 2.

FIG. 1 shows an assembled composite board system 20 formed of four rectangular boards or panels 22A–22D assembled side-by-side in a rectangular array. The board assembly front surfaces each bear an associated portion of an image which may include text 24 and non-text graphics 26 (e.g., charts, photographs, drawings, and the like). With the composite board assembled as shown in FIG. 1, the image 24, 26 is continuous across the various board subassemblies. The composite board assembly has a lateral perimeter defined by upper, lower, left and right edges 28A–28D. The composite board assembly has an overall height H and width W between those upper and lower and left and right edges, respectively. Each board subassembly includes a generally rectangular panel 32 (FIG. 2) having front and back planar surfaces 34A and 34B, respectively, and upper, lower, left, and night edges 36A–36D (FIG. 3). The panel has a panel width $W_P$, a panel height $H_P$ and a panel thickness $T_P$ (FIG. 4). Exemplary material for the panel is white polyethylene foam board (comprising a central section of polyethylene foam with both planar surfaces thereof covered by coated lithographic paper stock). Cardboard, plastic corrugated board, matte board, closed cell polyvinyl chloride (PVC) foam, or other appropriate materials may be alternatively utilized. Each board subassembly includes a plurality of bridge members secured to the back surface 34B of the associated panel. In the exemplary embodiment, each board subassembly includes four bridge members 40A–40D respectively associated with the edges 36A–36D. Each bridge member is formed of a pair of spacers 42A and 42B (FIG. 4) and a plate 44 bridging the spacers. The spacers have respective front and back surfaces 46A and 46B and the plate has respective front and back surfaces 48A and 48B. The spacers' front surfaces 46A are secured to the panel back surface 34B via an adhesive layer 50 and the spacers' back surfaces 46B are secured to the associated plate front surface via an adhesive layer 52. FIG. 4 also shows an adhesive layer 54 securing the paper or other sheeting material 56 bearing the image 24, 26 to the panel front surface 34A. Exemplary material for the plate 44 is 0.014-inch thick polyester film. Exemplary material for the spacers is polyethylene foam. Exemplary adhesive is rubber adhesive such as M&C Specialities W-5208 zone coating rubber adhesive.

Each spacer has a length $L_S$ (FIG. 3) between spacer end surfaces, a width $W_S$ (FIG. 4) between spacer inboard and outboard side surfaces 60A and 60B, and a thickness $T_S$ between spacer front and back surfaces 46A and 46B. In each bridge member, the two spacer inboard side surfaces 60A are spaced-apart from each other by a separation $S_S$ so as to bound two sides of a channel 62. Two additional sides of the channel are substantially defined by the front surface or underside 48A of the spacer and the back surface 34B of the panel (the adhesive layers 50 and 52, if intervening, being generally negligible). As shown in FIG. 3, relative to the panel the bridges 40A and 40B are oriented with their channel 62 vertically while the bridges 40C and 40D have their channels oriented transversely. With this in mind, the spacer length $L_S$ and plate length $L_{PL}$ (equal to $L_S$ in the exemplary embodiment) are defined parallel to the channel while spacer width and plate width $W_{PL}$ are defined transverse to the channel. In the exemplary embodiment $W_{PL}$ is equal to twice the spacer width plus the separation $S_S$.

Figure 5:
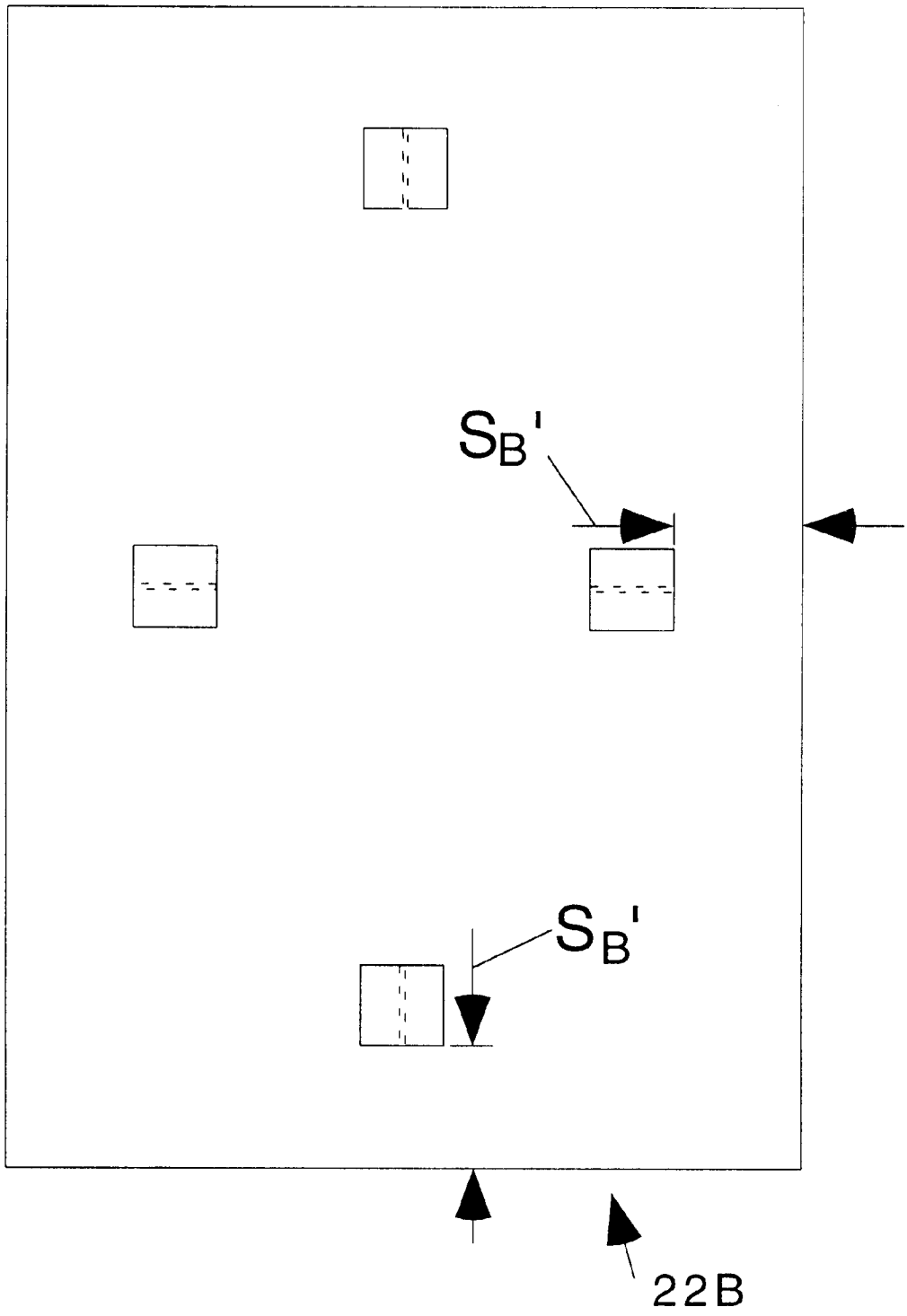
FIG. 5 is a back view of a second single board of the assembly of FIG. 1.
Figure 6:
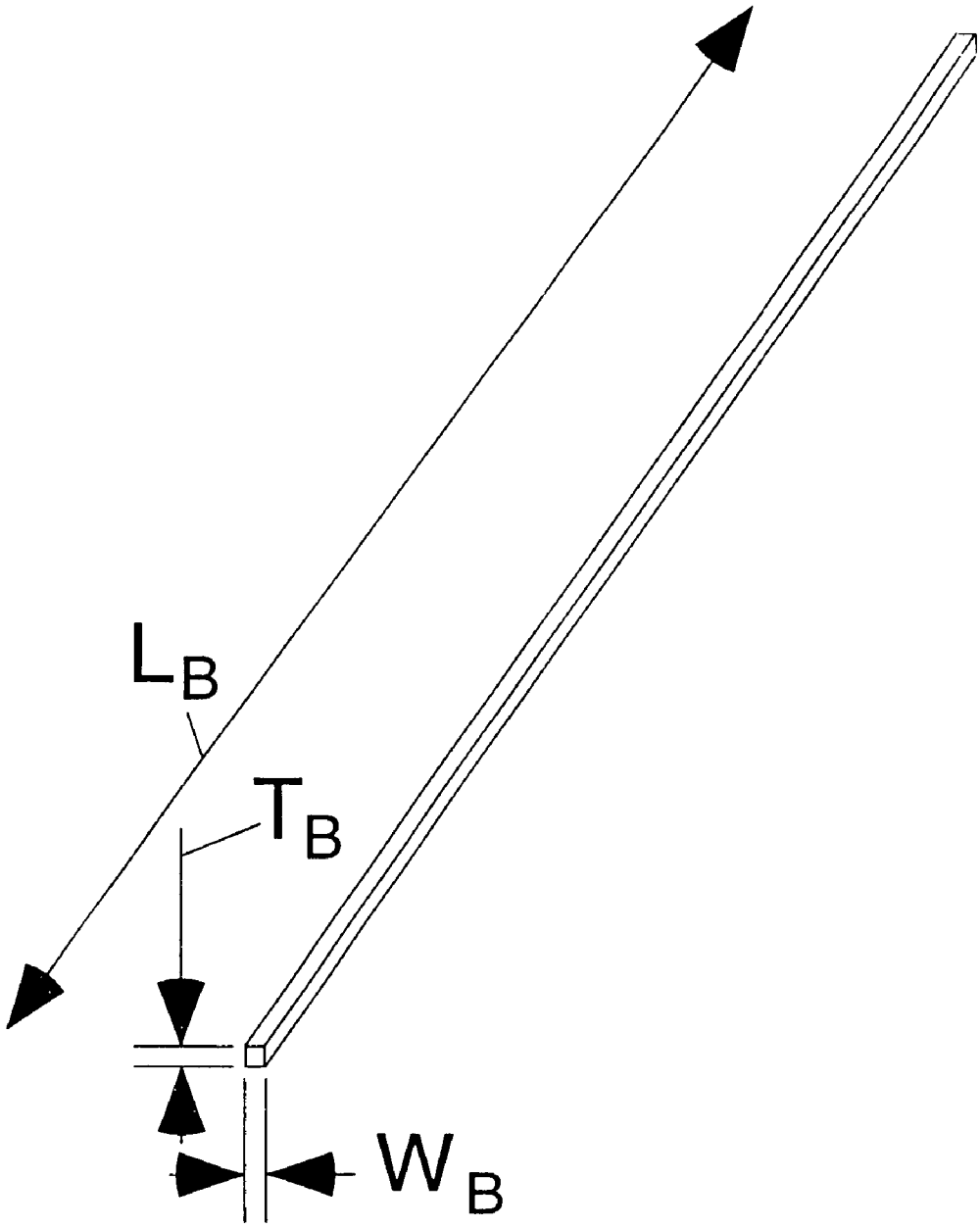
FIG. 6 is a view of a connecting bar.

As shown in FIG. 3, each bridge is preferably centered along its associated panel edge. The adjacent extremity of the bridge member (defined by the adjacent edge surface of the plate and the adjacent end surfaces of the spacers) is separated from the associated panel edge by a separation $S_B$ (FIG. 3). As shown in FIG. 1, the composite board assembly 20 includes two different types of board subassemblies distinguished by having two different separations. Whereas FIG. 3 shows an exemplary board 22A, having a relatively small separation $S_B$, FIG. 5 shows a board 22C having a relatively large such separation $S_B'$. The board subassembly 22D is identical to subassembly 22A as 22C is to 22B. As shown in FIG. 1, at each location where board subassemblies meet at a junction of at their associated panel edges, there is an associated pair of co-aligned bridge members on either side of the junction. A rigid shaft 64 extends through the channels of each such pair of bridge members. These shafts 64 function to maintain the board subassemblies substantially co-planar by resisting relative bending at the associated junctions. FIG. 6 shows an exemplary shaft 64 as a square-sectioned steel bar having a length $L_B$, a width $W_B$ and thickness $T_B$. The bar width and thickness are complementary to the spacer separation and spacer thickness, respectively, so that the bars fit closely within the associated bridge member channels, advantageously in a light friction fit. The bar length is effective to span the bridge members.

Exemplary dimensions in inches of a first preferred embodiment and a second preferred embodiment are given in the table below:

TABLE

| Dimension | 1st Embodiment | 2nd Embodiment |
|---|---|---|
| W | 40 | 20 |
| H | 60 | 30 |
| $W_P$ | 20 | 10 |
| $H_P$ | 30 | 15 |
| $T_P$ | 0.1875 | 0.1875 |
| $T_S$ | 0.115 | 0.115 |
| $L_S$ | 2.125 | 1.125 |
| $W_S$ | 1.000 | 0.500 |
| $S_S$ | 0.125 | 0.125 |
| $L_{PL}$ | 2.125 | 1.125 |
| $W_{PL}$ | 2.125 | 1.125 |
| $S_B$ | 0.5 | 0.5 |
| $S_B'$ | 3.125 | 2.125 |
| $T_B$ | 0.125 | 0.125 |
| $W_B$ | 0.125 | 0.125 |
| $L_B$ | 12.26 | 6.00 |

Figure 7:
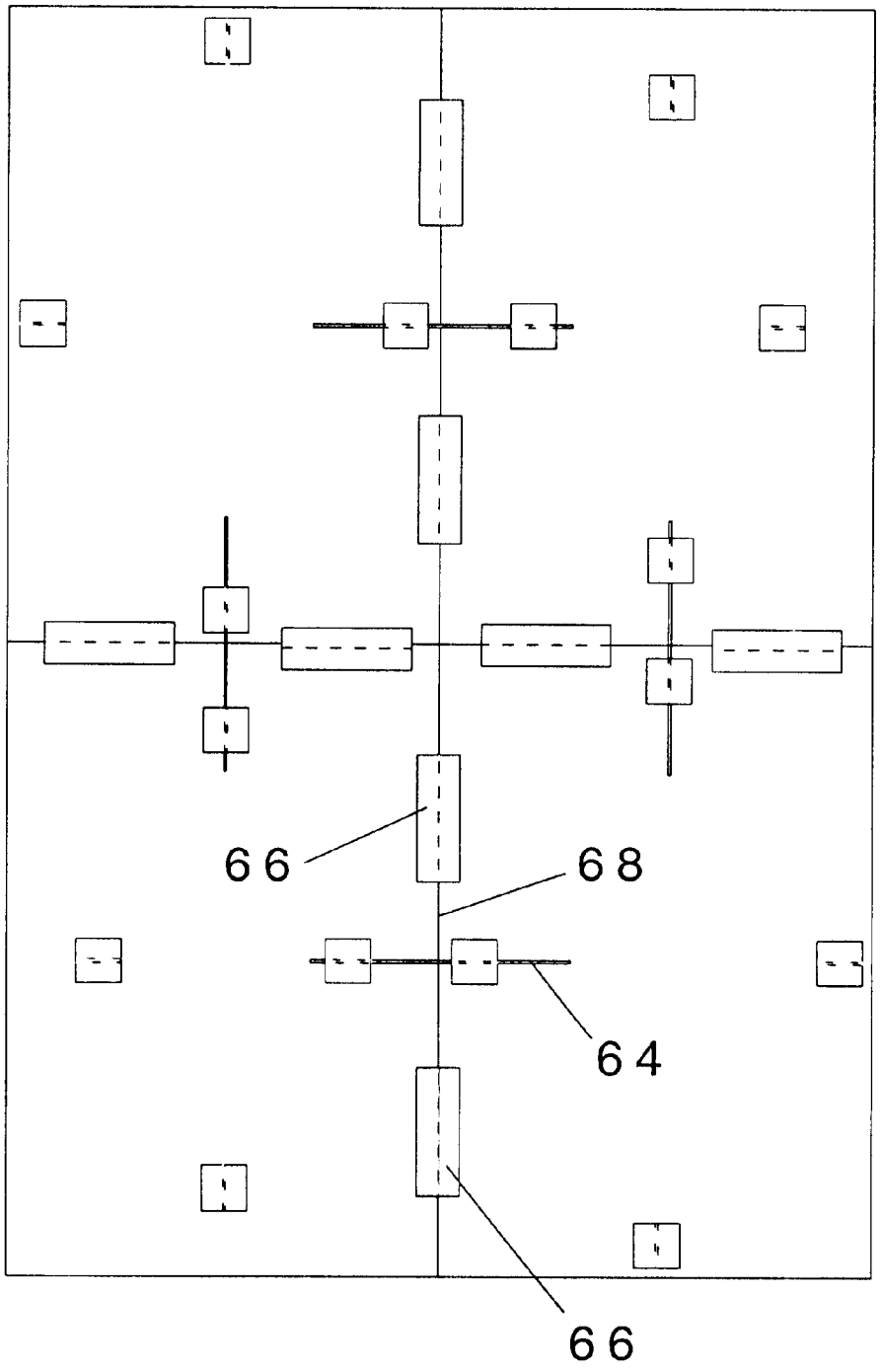
FIG. 7 is a back view of the composite board assembly of FIG. 1.

When the composite board is assembled, the junctions between panels may be taped over along the panel back surfaces to prevent separation of the board subassemblies along those junctions. This may include taping over the bars spanning those junctions (particularly if the channels become worn from use so that there is no longer a snug fit with the associated bars). FIG. 7 shows a more limited over taping involving two pieces of tape 66 along each junction 68 on either side of the associated bar 64.

Figure 8:
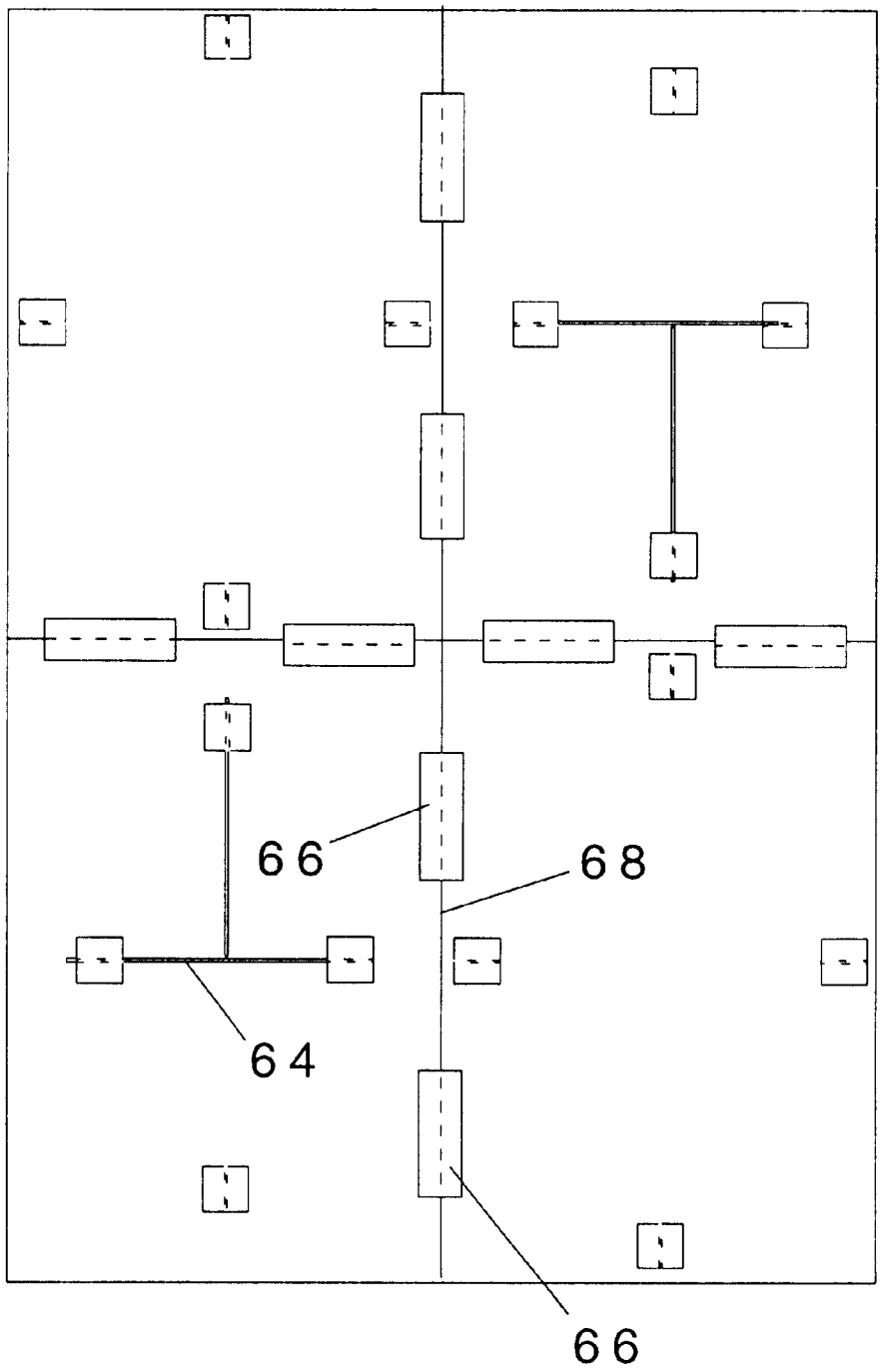
FIG. 8 is a back view of the assembly of FIG. 7 with bars in a withdrawn or retracted position permitting folding of the assembly.

In an exemplary rectangular array of board subassemblies, the junctions form orthogonal grid lines. For transportation and storage, the system may be folded along one or more such grid lines after the associated bars have been fully withdrawn from at least one of their associated pair of bridge members. For example as shown in FIG. 8, the bars may be withdrawn from one bridge member while remaining in engagement with the second so that the bar lies entirely behind only a single panel. When the assembly is folded along a given grid line, the back surfaces of the panels on either side of the grid line come together. When this occurs, the advantageous provision of two distinct types of panels having distinct separations $S_B$ and $S_B'$ facilitates a space-efficient nesting of the bridge members of such panels alongside each other rather than against each other.

In the four-panel example, upon withdrawal of the bars, the system may be folded along one of the two grid lines and then the tape along one of the two junctions of the second grid line is cut. The system may then be folded along the uncut junction of the second grid line with the uncut tape serving as hinge means. Such folding may provide a compact package with a height and width equivalent to that of only a single panel. Alternatively, the entire second grid line could be cut, dividing the assembly in two for such storage. In such a case, upon unfolding and re-assembly, the cut junctions could be re-taped. Such a division would be advantageous if not necessary in systems having more than four panels.

In commerce, the display system will not likely be sold pre-assembled. By way of components, one commercially feasible package includes a pair of board subassemblies (lacking images secured to their front surfaces) and at least one, but preferably two, bars. One bar will be needed to secure the boards to each other and two may ultimately be necessary if a large array is assembled.

An alternative commercial package includes merely selling the bridge members and bars for a user to secure to preexisting or otherwise obtained panels.

Figure 9:
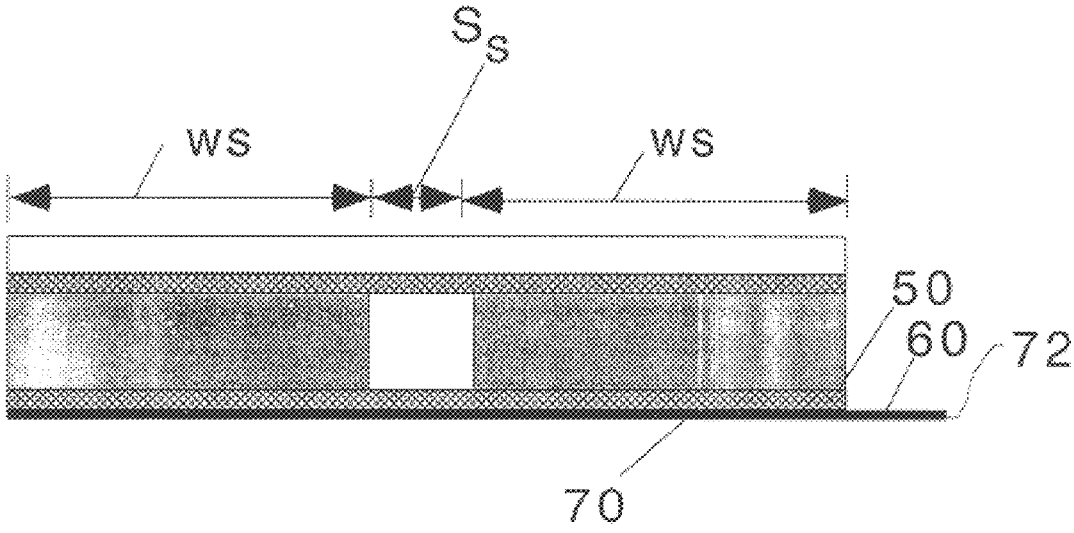
FIG. 9 is an end view of a bridge member having a layer of release paper.
Figure 10:
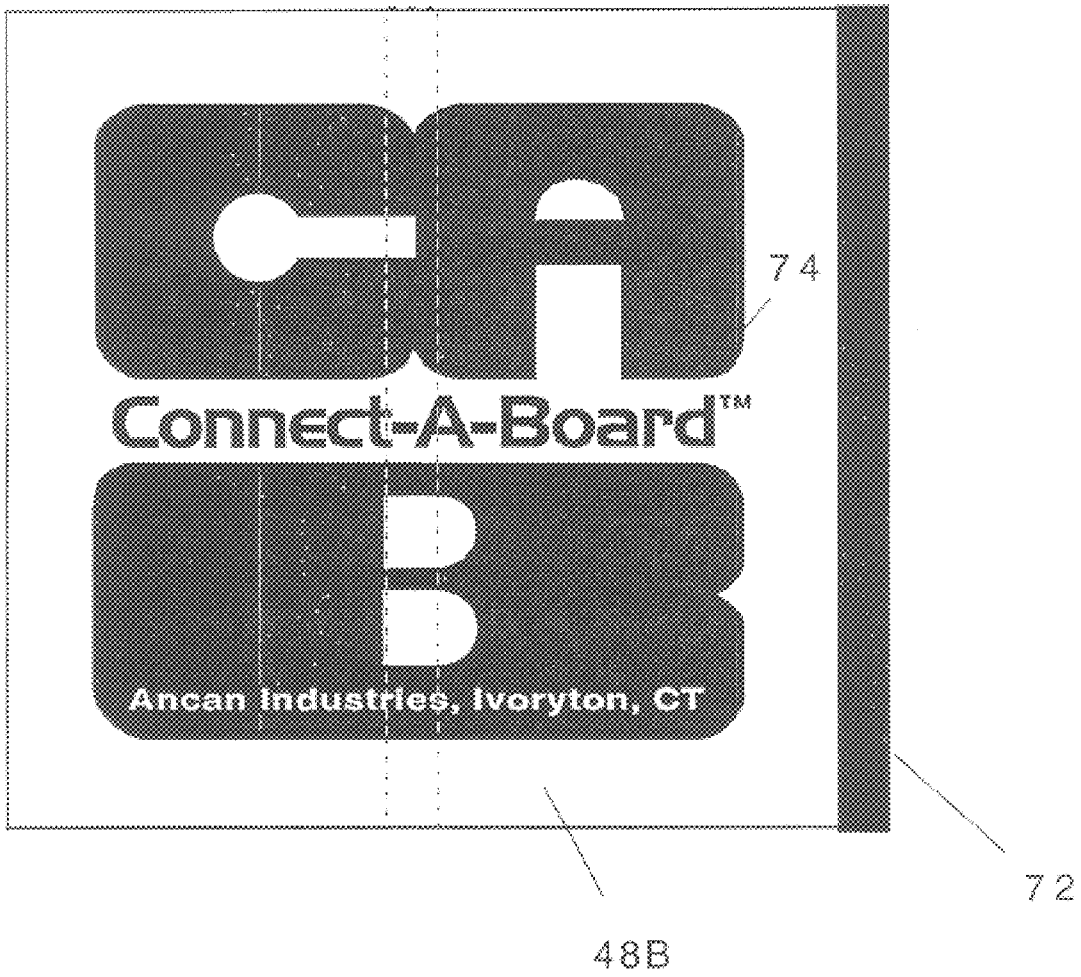
FIG. 10 is a back view of the bridge member of FIG. 9.

FIGS. 9 and 10 show a bridge member having a piece of release paper 70 covering its adhesive layer 50. One edge 72 of the release paper extends beyond the spacers, adhesive, and top plate by a distance effective to permit the user to grip and remove the loose paper from the adhesive layer 50. As shown in FIG. 10, the back surface 48B of the plate member may advantageously include images such as trademark or other source indicating text and graphics 74 (for example, being painted or dyed on or provided in the form of an adhesive label). Exemplary kits might include two such paper-backed bridge members and one bar or any multiple of such combination.

Figure 11:
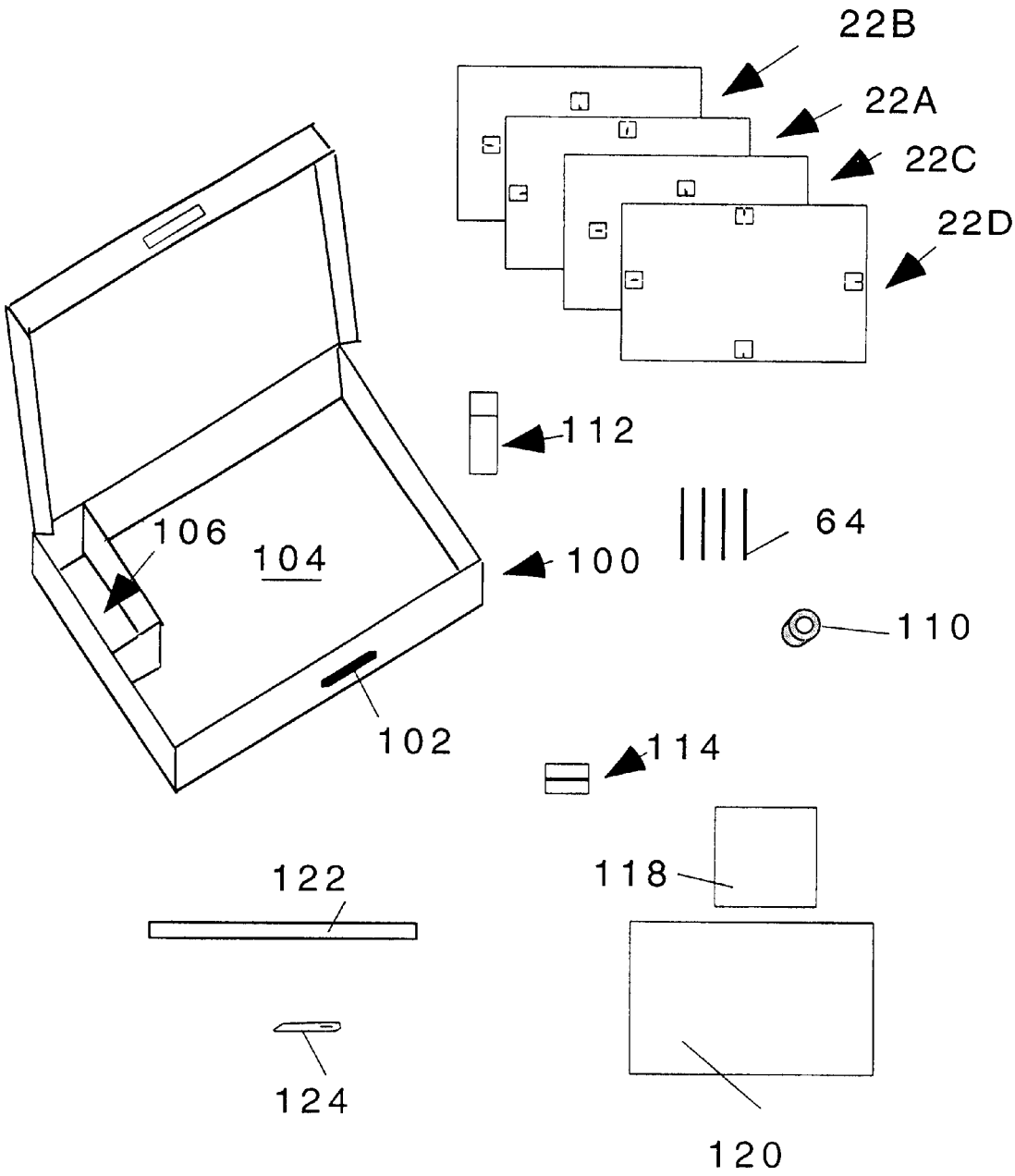
FIG. 11 is an exploded view of a kit for forming a composite board assembly.

A more comprehensive kit is shown in FIG. 11 and includes a corrugated cardboard carrying case 100 having a handle 102, a main compartment 104 and a secondary compartment 106 at one end of the main compartment. The kit includes four first embodiment board subassemblies lacking images, four bars, a roll 110 of polymer packaging tape to tape the junctions, a can 112 of spray adhesive for adhering the image-bearing paper to the board front surfaces (i.e., to provide the layer 54), a squeegee 114 for smoothing the paper when the paper is applied, a computer-readable media such as a CD-ROM containing tiling software for generating the image-bearing paper layers, a manual 120 for such software, and a ruler or other straight edge 122 as well as a utility knife 124 for cutting sheets of the image-bearing paper to size (as is described below). Exemplary dimensions for the case 100 are length, width and depth of approximately 35, 21 and 5.25 inches, respectively. Since such a size may be cumbersome in many situations, a smaller case (not shown) may be provided including four, eight or twelve board subassemblies of the second above-described embodiment.

Assembly of the system is straightforward. The individual board subassemblies are placed face down on a clean flat surface. A bar is inserted through adjacent bridge members on either side of each junction in the array of board subassemblies. The board subassemblies are carefully adjusted so that all junctions align perfectly to minimize any gaps between board subassemblies. The junctions are taped and the entire composite assembly may then be flipped over to receive the image-bearing paper sheet(s).

There are a variety of ways to generate the image-bearing paper sheet(s), one possibility is to initially provide a single image-bearing sheet substantially the entire width and height of the assembled system (or slightly greater) and secure such sheet across the assembled panel front surfaces. The sheet may be trimmed along the edges of the assembly and may further be cut along the junctions/grid lines to facilitate the folding of the subassemblies when the whole system is disassembled. Alternatively, individual sheets may be printed for each panel. Again, these may advantageously be exactly the panel size or, if larger than the panel, there may be redundant image portions along portions of the sheets which, when trimmed along the junction/grid line, cause a continuous image to appear across the various panels. Yet another possibility involves sheets which are less than the size of the individual panels. This would permit the sheets to be provided on letter, legal, or ledger-size paper that can readily be run through a desk-top or other laser or ink jet printer. In such a situation, the tiling software receives the image in digital format and, based upon input or preprogrammed display parameters (e.g., panel and assembly size), prints, for each panel, an appropriate combination of sheets/tiles each bearing a portion of the image. Again redundant image portions may be provided extending beyond the perimeter of a given panel which are then cut away.

With an exemplary tiling software, the user either creates or otherwise inputs the image to the software. The user then selects the ultimate desired width and height of the composite board assembly. Exemplary kit instructions provide a look-up table by which the user determines the appropriate values to use for specifying the display final size in the printing software. The table then identifies the number and arrangement of individual boards necessary to provide the size. This may entail the provision of excess area which may ultimately be trimmed. With overall dimensions thus selected, the software provides corresponding image sizes which reflect a desired border. For example, the image dimensions may be approximately 0.3 inches less than the corresponding overall dimensions. The software then prints the appropriate tiles for the image size.

Figure 12:
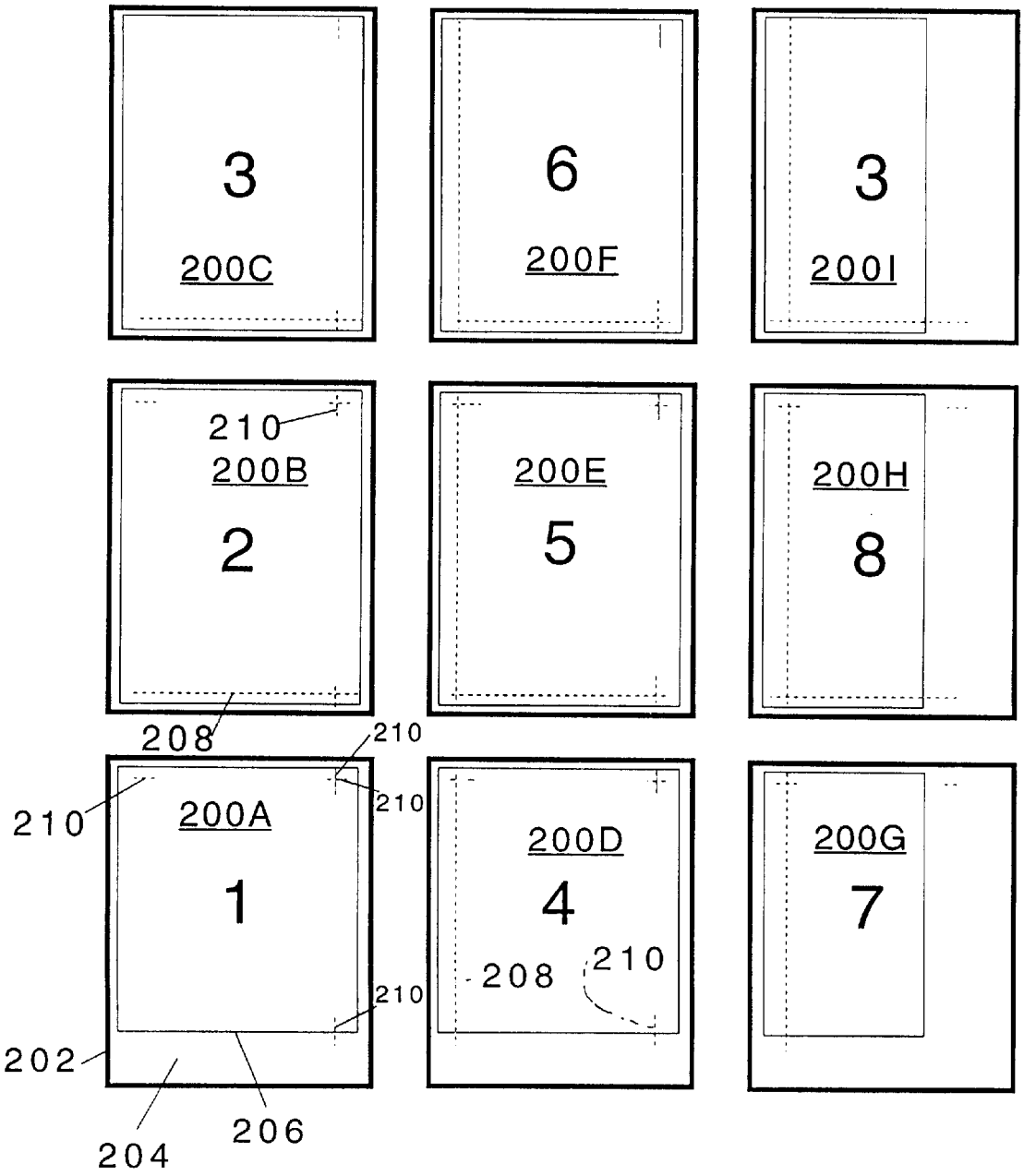
FIG. 12 is an exploded view of an array of tiles.

FIG. 12 shows an exemplary array of tiles 200A–200I generated by the software. Each tile is printed on a given size of paper sheet or other medium (e.g., 8.5 by 11 inch paper). Each tile or sheet includes a perimeter 202 and a front surface 204 bearing overlapping portions of the composite image and other indicia. The exemplary array is dimensioned for use on a single 20 by 30 inch board to provide an overall image size of 19.125 in×26.75 in with a border of 0.3125 in so that the board may be cut down to a size of 19.75 in×27.375 in. The image portion printed on each sheet has a perimeter 206 which can be recessed relative to the sheet perimeter 202. Printed on various of the sheets are trim lines 208. Each sheet may be cut along the trim line(s) and the portion(s) between the trim line(s) and the sheet perimeter removed prior to installation of the sheet on the board assembly. The primary purpose of the trimming is to remove a border area of the subject sheet to permit the subject sheet to be overlaid on top of one or more adjacent sheets so that the image portion on the subject sheet registers with the image portion on the adjacent sheet(s). To facilitate this, the sheets are also provided with registry lines 210.

The exemplary software which prepared the sheets of FIG. 12 is configured to allow the sheets to be pasted up in ascending order from a lower left sheet 200A up the first (left) column to an upper left sheet 200C then repeating column by column for each successive column to the right. To do this, after the sheets are printed, the user first trims the bottom edge of each lower row or bottom tile (i.e., 200A, 200D, and 200G in the exemplary embodiment). This may be done by a desired border separation from the adjacent portion of the perimeter 206 (e.g., by 5/16 inch). All sheets are then trimmed along their associated trim lines 208. With the assembled composite board (or single board in the example) lying face up, the trimmed first sheet 200A is pasted to the front of the associated board using the spray adhesive. In the illustrated example, the left edge and trimmed bottom edge are registered with the left and bottom edges of the board. Because it is the first sheet, no trim lines 208 are necessary on sheet 200A. The second sheet 200B is then pasted to the board, with its left edge registered with the left edge of the board and its trimmed bottom edge (i.e., along its single trim line 208) registered with corresponding horizontal registry lines 210 of the first sheet to just obscure such registry lines. The remaining sheets in this first column (i.e., the single sheet 200C in the example) are secured in similar fashion. The bottom sheet in the second row (i.e., sheet 200D) is then pasted so that its trimmed bottom edge registers with the board bottom edge and its trimmed left edge registers with right vertical registry lines of the first sheet 200A. The next sheet in this column is pasted so that its trimmed bottom and left edges register with the upper and right registry lines of the adjacent tiles (e.g., 200D and 200B respectively). The remaining sheets in the column are secured in a similar fashion. The remaining columns of sheets are then similarly secured.

The assembled display may then be trimmed to the desired overall dimensions. The assembled system may be disassembled as noted above and repacked in its display case for transportation and subsequent re-assembly and reuse.

Figure 13:
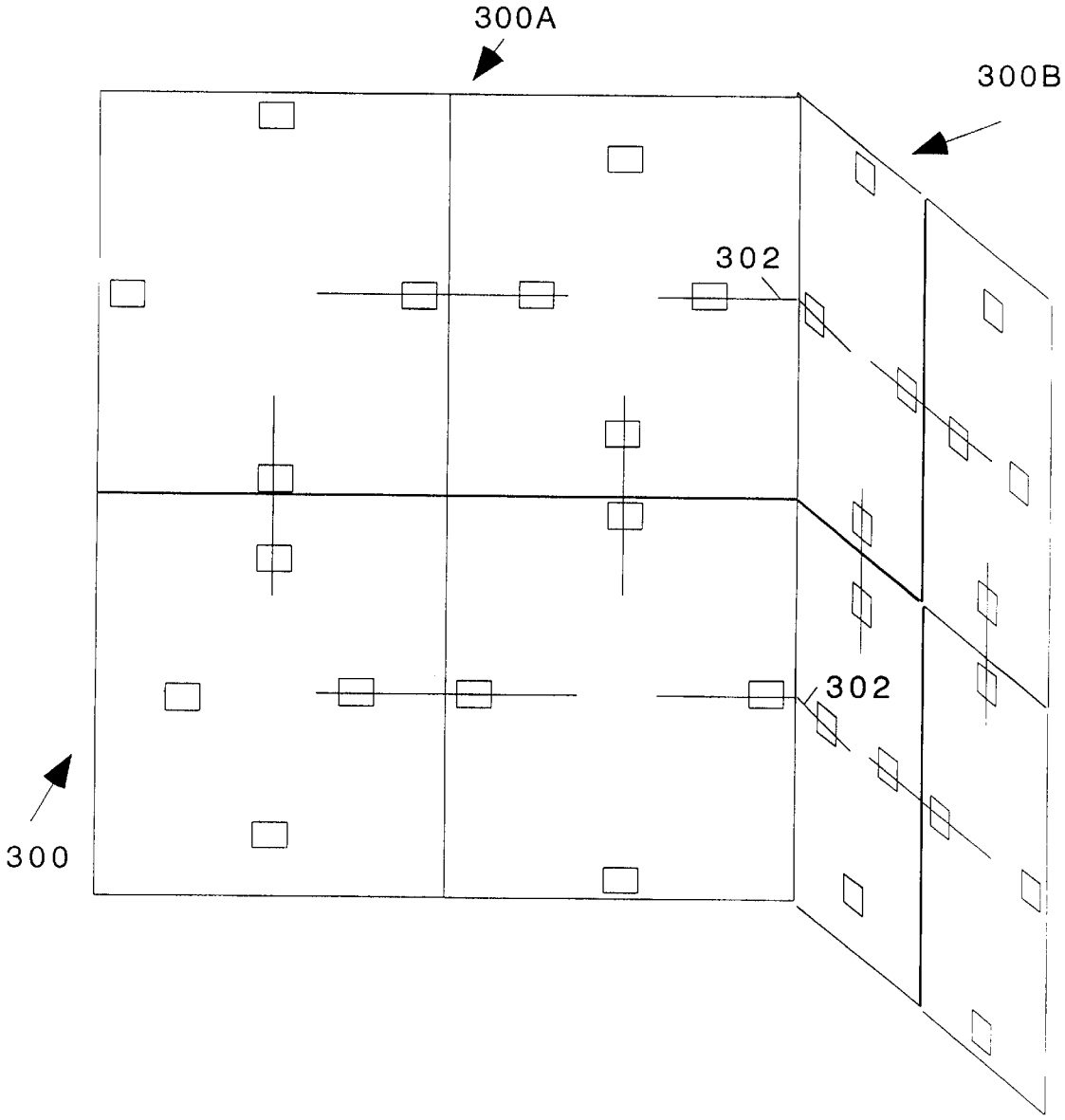
FIG. 13 is a view of a non-planar composite board assembly.

FIG. 13 shows a composite board system 300 in which one or more bars 302 are bent at a given angle so that two subunits 300A and 300B of the assembly 300 can be oriented at that same angle relative to each other.

Figure 14:
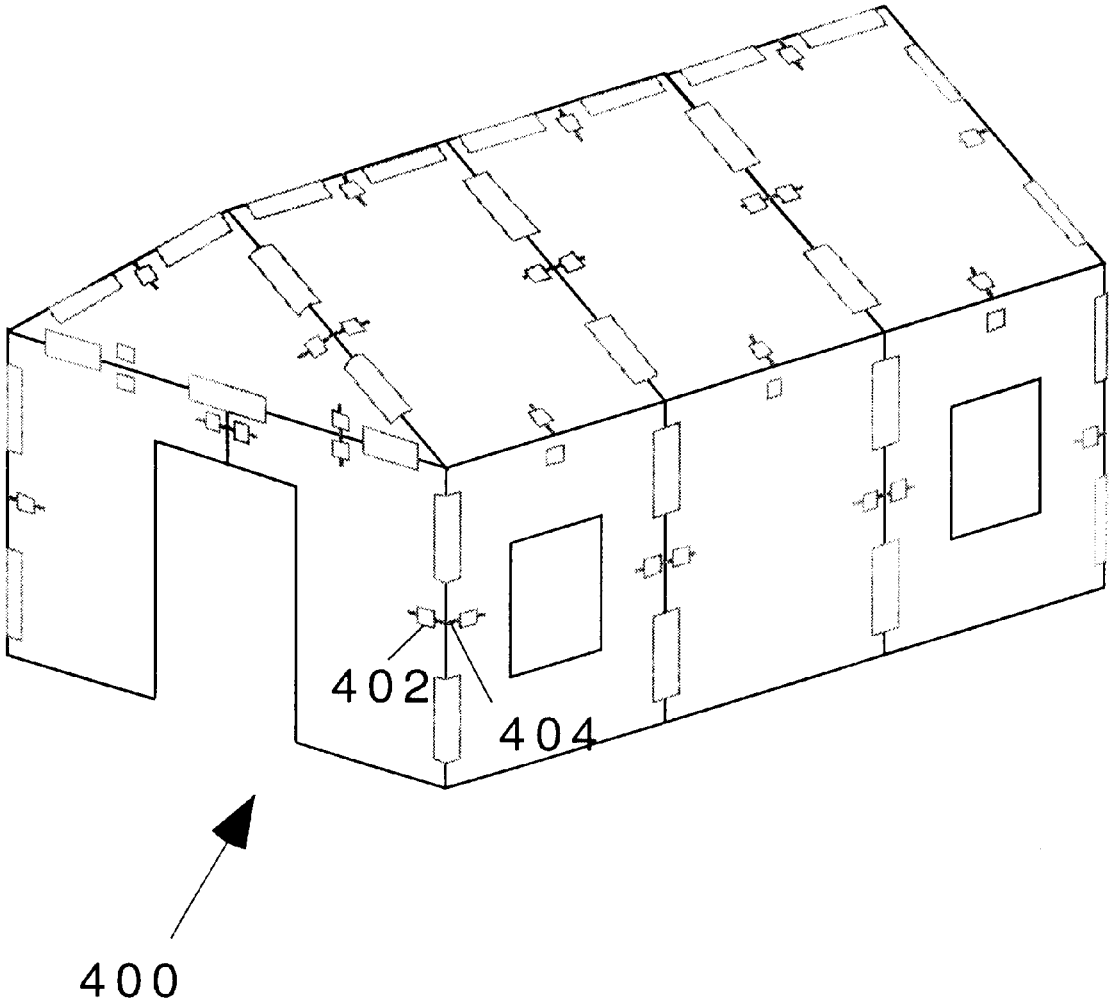
FIG. 14 is a view of an alternate structure assembly.

FIG. 14 shows a system 400 making alternate use of bridge members 402 and bars 404 to assemble a child's playhouse having a plurality of walls, each wall including one or more panels. The panels of the playhouse are coupled to each other in similar fashion to the panels of the composite board assembly 20 with the bars 404 being straight or bent depending on whether the adjacent panels being coupled are at an angle to each other. As with the assembly 20, the various panel junctions may be additionally secured via tape. Graphics may or may not cover the panels of this non-planar structural assembly.

One or more embodiments of the present invention have been described. Nevertheless, it will be understood that various modifications may be made without departing from the spirit and scope of the invention. For example, a variety of materials and manufacturing techniques may be utilized. Also, a variety of boards and overall dimensions may be utilized as may be a variety of assembly configurations. Accordingly, other embodiments are within the scope of the following claims.

What is claimed is:

1. A single module for assembling a composite graphical image-bearing assembly comprising:

a graphic display board having:

front and back surfaces with a board thickness therebetween;

first and second parallel perimeter edges with a board width therebetween; and third and fourth parallel perimeter edges with a board height therebetween; at least one bridging member secured to the graphic display board back surface, each having;

a pair of spacer portions having first surfaces facing and secured to the graphic display board back surface; and a plate portion bridging the spacer portions and defining a channel between the spacer portions: and wherein there are exactly four bridging members; and each such bridging member is centered along an associated one of said perimeter edges and recessed from said associated perimeter edge by an associated offset; and wherein said single module being a first module in combination with a second such module wherein:

the offsets of the first module and of the second module are effective to permit:

back-to-back nesting of the modules with their boards aligned with each other but their bridging members aside each other so that the bridging members of each board may contact the back of the other board; and edge-to-edge assembly of the modules with a connecting bar extending through a channel of the first module and a channel of the second module.

2. The module combination of claim 1 further including a plurality of additional modules assembled in a rectangular edge-to-edge array wherein:

along adjacent edges of any given two adjacent modules in the array, a connecting bar spans the border between such adjacent modules and extends within the bridging member channel associated with each of the adjacent edges; and the board front surfaces of each module are substantially coplanar and each bears a graphical image portion, the graphical image portions combining to form a single continuous graphical image over the array.

3. A composite board system having deployed and stowed conditions including:

a plurality of panels, each having a back surface, in the deployed position forming a rectangular array;

a plurality of bridge members, each secured to the back surface of an associated one of the panels;

a plurality of bar members, in the deployed condition extending into a channel in each of two such bridge members of two such panels; and at least one hinge along an associated junction between a pair of said panels;

wherein said hinge comprises tape adhered to said back surfaces of said pair of panels.

4. A composite board system having deployed and stowed conditions and including:

a plurality of panels, each having a back surface, in the deployed position forming a rectangular array;

a plurality of bridge members, each secured to the back surface of an associated one of the panels;

a plurality of bar members, in the deployed condition extending into a channel in each of two such bridge members of two such panels; and at least one hinge along an associated junction between a pair of said panels; wherein each said bridge members comprises:

first and second coplanar securing surfaces;

a central surface parallel to, recessed from and between the first and second securing surfaces; and an adhesive on the first and second securing surfaces securing such bridge member to the back surface of the associated one of the panels so that the central surface is spaced apart from such back surface.

5. The system of claim 4 wherein each of said bridge members comprises:

a plate portion having first and second opposed surfaces and a plate thickness therebetween, an exposed central portion of the plate portion second surface defining said central surface;

first and second spacer portions, each having first and second opposed surfaces, the first surfaces of the first and second spacer portions secured to the plate portion second surface, with the spacer portions spaced apart so that the second surfaces of the first and second spacer portions respectively define the first and second securing surfaces; and release material covering said adhesive on said first and second securing surfaces.

6. The system of claim 5 wherein for each of said bridge members:

the first and second spacer portions each comprise a foam strip with said adhesive on one side and additional adhesive on an opposite side securing the strip to the plate portion; and the plate portion first surface bears graphics, said graphics including text.

* * * * *